US008100579B2

(12) United States Patent
Levingston

(10) Patent No.: US 8,100,579 B2
(45) Date of Patent: Jan. 24, 2012

(54) THERMALLY COMPENSATING BALANCE WHEEL

(76) Inventor: Gideon Levingston, Grasse (FR)

( * ) Notice: Subject to any disclaimer, the term of this patent is extended or adjusted under 35 U.S.C. 154(b) by 290 days.

(21) Appl. No.: 12/440,548

(22) PCT Filed: Sep. 6, 2007

(86) PCT No.: PCT/GB2007/003386

§ 371 (c)(1),
(2), (4) Date: Oct. 5, 2009

(87) PCT Pub. No.: WO2008/029158

PCT Pub. Date: Mar. 13, 2008

(65) Prior Publication Data

US 2010/0034057 A1 Feb. 11, 2010

(30) Foreign Application Priority Data

Sep. 8, 2006 (GB) ..... 0617662.2
Jan. 24, 2007 (GB) ..... 0701299.0

(51) Int. Cl.
*G04B 17/20* (2006.01)

(52) U.S. Cl. ..... 368/171; 368/170

(58) Field of Classification Search ..... 368/127, 368/161, 169–174, 181–182
See application file for complete search history.

(56) References Cited

U.S. PATENT DOCUMENTS 206,642 A 11/1878 Berlitz
455,787 A 7/1891 Bilgram
1,350,035 A * 8/1920 Povelsen ..... 368/171
1,859,866 A * 5/1932 Werner ..... 368/171
1,951,995 A * 3/1934 Schaad ..... 368/169
1,974,695 A 9/1934 Strauman
1,982,726 A 12/1934 Ditisheim
2,072,489 A * 3/1937 Straumann ..... 420/94
2,116,257 A * 5/1938 Aegler ..... 368/171
2,232,742 A * 2/1941 Smith ..... 83/55
2,568,326 A 9/1951 Dubois
2,936,572 A * 5/1960 Biemiller et al. ..... 368/171
3,187,416 A 6/1965 Tuetey et al.
3,547,713 A 12/1970 Steinemann et al.
3,624,883 A 12/1971 Baehni
3,683,616 A 8/1972 Steinemann et al.

(Continued)

FOREIGN PATENT DOCUMENTS

CH 34141 3/1906

(Continued)

OTHER PUBLICATIONS

Dictionnaire Professionel Illustre de L'Horlogerie, "XP-002313758," 1961, pp. 828-831.

(Continued)

*Primary Examiner* — Vit Miska
(74) *Attorney, Agent, or Firm* — Stites & Harbison PLLC; Douglas E. Jackson

(57) ABSTRACT

A balance wheel having a thermally adjustable moment of inertia is described. In one aspect, the balance wheel includes radially movable compensation portions formed of shape memory material exhibiting a two-way memory effect. The radius of gyration of the balance wheel is therefore adjustable with temperature to compensate for thermoelastic effects in a balance spring attached to the balance wheel. In another aspect, a thermally stable balance wheel includes dynamically adjusting appendages whose expansion or contraction with temperature relative to the balance wheel cause change in its moment of inertia. The invention can compensate for both 'normal' and 'abnormal' thermoelastic spring behavior.

15 Claims, 3 Drawing Sheets

U.S. PATENT DOCUMENTS

| | | | |
|---|---|---|---|
| 3,735,971 | A | 5/1973 | Steinemann |
| 3,773,570 | A | 11/1973 | Steinemann et al. |
| 3,813,872 | A | 6/1974 | Nakagawa et al. |
| 4,260,143 | A | 4/1981 | Kliger |
| 4,765,602 | A | 8/1988 | Roeseler |
| 5,043,117 | A | 8/1991 | Adachi et al. |
| 5,617,377 | A | 4/1997 | Perret |
| 5,678,809 | A | 10/1997 | Nakagawa et al. |
| 5,881,026 | A | 3/1999 | Baur et al. |
| 5,907,524 | A | 5/1999 | Marmy et al. |
| 6,329,066 | B1 | 12/2001 | Baur et al. |
| 6,357,733 | B1 | 3/2002 | Wulz et al. |
| 6,527,435 | B2 | 3/2003 | Thalheim |
| 6,666,575 | B2 | 12/2003 | Scheufele |
| 6,705,601 | B2 | 3/2004 | Baur et al. |
| 7,077,562 | B2 | 7/2006 | Bourgeois et al. |
| 2002/0070203 | A1 | 6/2002 | Serex |
| 2002/0167865 | A1 | 11/2002 | Tokoro et al. |
| 2004/0174775 | A1 | 9/2004 | Muller |
| 2005/0219957 | A1 | 10/2005 | Lambert et al. |
| 2006/0055097 | A1 | 3/2006 | Conus et al. |
| 2006/0225526 | A1 | 10/2006 | Levingston |
| 2007/0140065 | A1 | 6/2007 | Levingston |

FOREIGN PATENT DOCUMENTS

| | | |
|---|---|---|
| CH | 129 338 | 12/1928 |
| DE | 19651320 | 6/1998 |
| DE | 19651321 | 6/1998 |
| DE | 19651322 | 6/1998 |
| EP | 0 393 226 | 10/1990 |
| EP | 0 732 635 | 9/1996 |
| EP | 0 886 195 | 12/1998 |
| EP | 1 039 352 | 9/2000 |
| EP | 1 256 854 | 11/2002 |
| EP | 1 513 029 | 3/2005 |
| EP | 1 515 200 | 3/2005 |
| FR | 2136084 | 12/1972 |
| GB | 1180762 | 2/1970 |
| GB | 2 041 152 | 9/1980 |
| JP | 64-006537 | 1/1989 |
| JP | 01-110906 | 4/1989 |
| JP | 01-110907 | 4/1989 |
| JP | 01-110908 | 4/1989 |
| JP | 01-110909 | 4/1989 |
| JP | 07-138067 | 5/1995 |
| JP | 09-257069 | 9/1997 |
| JP | 11-147769 | 6/1999 |
| WO | WO 96/14519 | 5/1996 |
| WO | WO 01/01204 | 1/2001 |
| WO | WO 2005/017631 | 2/2005 |
| WO | WO 2006/123095 | 11/2006 |

OTHER PUBLICATIONS

Edwards, Evan, "Carbon Fibre Pendulum Rods," Jun. 2000, Horological Journal, pp. 190-191.

Guillaume, Charles-E., "Invar and elinvar," Dec. 11, 1920, Nobel Lecture, pp. 444-473.

Levingston, Gideon, "A New Material for Balance Springs," Jul. 2004, Horological Journal, pp. 243-245.

Randall, Anthony G., "Glass Balance Springs—part 1," Encyclopédie Horlogerie, www.worldtempus.com/wt/1/2659.

Randall, Anthony G., "Glass Balance Springs—part 2," Encyclopédie Horlogerie, www.worldtempus.com/wt/1/2660.

Stephen, Richard, "Carbon Fibre Rods for Pendulums," Feb. 2000, Horological Journal, p. 47.

* cited by examiner

THERMALLY COMPENSATING BALANCE WHEEL

TECHNICAL FIELD

The present invention relates to a balance wheel for a horological mechanism or other precision timing instrument. For example, the invention may be used in a mechanical oscillator for a precision watch.

BACKGROUND TO THE INVENTION

Conventionally, balance wheels for watches are made principally from metal. In a horological mechanism, a balance spring (e.g. hairspring) is arranged to oscillate the balance wheel, ideally with an isochronous period of oscillation.

The period of oscillation T of a horological mechanism is given by the equation $$T = 2\pi\sqrt{\frac{1}{G}}, \quad (1)$$

where I is the moment of inertia of the balance wheel and G is the torque of the balance spring. Further, $$I \propto Mr^2, \quad (2)$$

where M is the mass of the balance wheel and r is its radius of gyration.

External influences such as temperature change and magnetism can affect properties of the balance spring and balance wheel which can cause variations in the period of oscillation. For the horological mechanism to be accurate in use, e.g. permit accurate time keeping, it is necessary to compensate for these external influences.

The effects of a temperature change on the balance wheel and the balance spring are not the same. Whereas the balance wheel is in general only affected by thermal variations, which affect its physical dimensions, commonly employed balance springs are typically affected by both thermal and magnetic variations, which affect both their physical dimensions, and their elasticity (Young's modulus).

Thermal compensation in a horological mechanism relates to controlling the relationship between the thermal evolution of I and G to provide a constant value of T across a temperature range of interest. The most successful previous attempts at this were C. E. Guillaume's bimetallic compensating balance wheel and steel balance spring system (invented in 1912) and Hamilton's precision ferro-nickel based spring alloy in conjunction with a steel and invar ovalising balance wheel (invented in 1943). Both these attempts required the use of materials which despite their useful thermal characteristics (e.g. the ferro-nickel alloys with an abnormal Young's modulus evolution) were sensitive to magnetism. This latter influence disturbs the Young's modulus stability and causes negative effects to the precision (isochronism) of these devices.

The inventor's earlier patent publications WO 2004/008259 and WO 2005/040943, incorporated herein by reference, disclose techniques for compensating for the effects of both temperature change and magnetism.

WO 2004/008259 describes balance spring materials which enable the thermal and magnetic effects to be greatly reduced or eliminated, thereby permitting greater precision. In particular, this publication disclosed selecting materials which would permit a change in period ΔT caused by a rise in temperature of 1° C. to tend to zero. ΔT can be written as $$\Delta T = \alpha_1 - \frac{3}{2}\alpha_2 - \frac{1}{2}\frac{\delta E}{E}, \quad (3)$$

where $\alpha_1$ is the coefficient of thermal expansion of the balance wheel, $\alpha_2$ is the coefficient of thermal expansion of the balance spring and $$\frac{\delta E}{E}$$

is the thermoelastic coefficient of the balance spring. WO 2004/008259 described materials with small values for $\alpha_1$ and $\alpha_2$ (e.g. less than $6\times10^{-6}$ $K^{-1}$) and a small value for $$\frac{\delta E}{E},$$

which permitted ΔT to be reduced more readily.

WO 2005/040943 describes a thermally compensating non-magnetic balance wheel for use in conjunction with a thermally stable non-magnetic balance spring in a mechanical oscillator system in a horological or other precision instrument, the balance wheel including components of two different materials having different coefficients of thermal expansion, the components being arranged to give equipoise to the balance wheel and to cause a decrease in the moment of inertia of the balance wheel with an increase in temperature, wherein the decrease in the moment of inertia is arranged to compensate for changes in the elasticity of the balance spring caused by the increase in temperature. A thermally stable spring is a spring made from a material having a low thermal expansion coefficient, e.g. of a material disclosed in WO 2004/008259.

SUMMARY OF THE INVENTION

The disclosure herein builds on WO 2004/008259 and WO 2005/040943 by presenting two further compensation techniques for balance wheels. Both techniques are based on causing the radius of gyration r of the balance wheel to change when there is a temperature change, e.g. to compensate for expansion or contraction of the balance wheel or balance spring and/or for any change in elasticity in the spring caused by the temperature change.

The techniques disclosed are applicable to springs which exhibit both 'normal' thermoelastic behavior (i.e. a negative thermoelastic modulus coefficient) and 'abnormal' thermoelastic behavior. For 'normal' springs, an increase in temperature causes the balance spring to be less elastic (i.e. experience a decrease in Young's modulus). 'Abnormal' springs become more elastic (i.e. experience an increase in Young's modulus) with an increase in temperature.

To compensate for the changes in elasticity of a 'normal' balance spring and thereby allow an oscillator to remain isochronous a balance wheel needs to reduce its moment of inertia. In the two aspects of the present invention this is done by reducing the radius of gyration. Likewise, to compensate for the changes in elasticity of an 'abnormal' balance spring a balance wheel needs to increase its moment of inertia. In the two aspects of the present invention this is done by increasing the radius of gyration.

In this context, the radius of gyration r is a measure of mass distribution about the centre of mass of the balance wheel. Thus, the radius of gyration can be varied by causing relative displacement of a part or parts of the balance wheel mass towards or away from the centre of mass of the balance wheel.

Shape Memory Material

At its most general, the first aspect of the invention proposes the use of shape memory material in a balance wheel to provide a change in its moment of inertia with a change in temperature.

Shape memory materials display particular and intrinsic behavior at the atomic level in phase transformations from austentite to martensite. This is known as thermoelastic martensitic transformation. The change in behavior is brought about by a change in temperature and can be controlled, particularly in the ambient range e.g. 5-38° C. The thermoelastic martensitic transformation which can cause a particular shape to be recovered is a result of a requirement within the crystal lattice structure of the material to realign to a minimum energy state at a given temperature. Thus, a shape memory material may pass from a ductile martensitic state to a more rigid original shape upon heating above a particular transformation temperature. This is known as one-way shape memory effect.

It is also possible to have two-way shape memory effect such that with a rise in temperature one shape change occurs and as the temperature lowers the original shape is regained. This is achieved by pre-programming i.e. "training" the material to provide a shape change which alters the radius of gyration when the temperature increases through a transformation temperature zone. Pre-programming is typically achieved by performing a repeated cycle of bending the cooled material to the desired shape and subsequently heating to above a threshold temperature (i.e. the austentitic transformation temperature) whereupon the original shape is regained. The cycle may be repeated 20-30 times to complete the pre-programming.

Where the shape memory material is a shape memory alloy (SMA), changing the alloy composition may permit a transformation temperature zone, i.e. a region around the austentitic transformation temperature between the states, to be adjusted to a required operating temperature.

Thus, according to the first aspect of the invention, there may be provided a balance wheel for a mechanical oscillator system in a horological or other precision instrument, all or part of the balance wheel comprising shape memory material that is arranged to change shape with an increase or decrease in temperature to alter a mass distribution of the balance wheel relative to its centre of mass. The balance wheel thus effectively has a temperature dependent shape. The change in shape may be expressed as a return to an original crystallographic configuration following an initial deformation.

Alternatively, the first aspect of the invention may be expressed as a thermally compensating balance wheel for use in conjunction with a thermally stable balance spring in a mechanical oscillator system in a horological or other precision instrument, the balance wheel including a compensation portion made of shape memory material, wherein the compensation portion is arranged to change shape with an increase or decrease in temperature to alter a mass distribution of the balance wheel relative to its centre of mass to compensate for a change in the elasticity of the balance spring caused by the increase or decrease in temperature.

In the invention, the mass distribution is changed e.g. through a change in shape of a piece of mono-material, i.e. an element with a substantially uniform composition. In contrast, previous compensation arrangements relied on different relative linear thermal coefficient changes in the material or combination of materials.

The shape memory material may be pre-programmed to exhibit the two-way shape memory effect so that compensating shape changes can occur for both increases and decreases in temperature. Thus, for an increase or decrease in temperature the shape of the compensation portion changes to provide a relative mass displacement within the mass distribution of the balance wheel, thereby causing a change in the overall inertial effect of the balance wheel. In this case, the change in shape may be expressed as repeatable movement between a first and a second temperature dependent crystallographic configuration.

The relative mass displacement may be arranged to couple with and therefore compensate for either negative or positive elastic modulus changes in the balance spring. Thus, the present invention can compensate for both 'normal' and 'abnormal' thermoelastic behavior.

The compensation portion may include two or more discrete shape changing elements located on the balance wheel such that it has equipoise. The shape changing elements may be integral with the balance wheel or separate attachments thereto. In one embodiment, the balance wheel may have a rim and a cross member and the shape changing elements may be a part or parts e.g. circumferentially extending parts of the rim. In an alternative embodiment, the balance wheel may comprise a disc-shaped body with recesses in which the shape changing elements are mounted. In this embodiment, the body may be made of a thermally stable material, e.g. having a linear thermal expansion coefficient of $9\times10^{-6}$ $K^{-1}$ or less, preferably $8.7\times10^{-6}$ $K^{-1}$ of less, more preferably $1\times10^{-6}$ $K^{-1}$ or less. Using a thermally stable body can reduce the amount that the compensation portion must change to achieve compensation because the effect of temperature changes on the balance wheel is less pronounced. Where thermally stable materials are used for both the balance wheel body and balance spring, the change in elasticity of the balance spring may be the dominant effect that requires compensation.

The shape changing elements may be arranged to move radially inwards or outwards within the plane of the balance wheel with an increase or decrease in temperature. The direction of movement is selected (i.e. pre-programmed) according to the balance spring's positive or negative elastic modulus variation characteristic.

The shape changing element may include a mass element that is movable relative to the centre of mass of the balance wheel when the shape memory material changes shape. This may permit greater control of the change in moment of inertia and/or a greater dynamic range for compensation.

The shape memory material may be a shape memory alloy or polymer. One advantage of a shape memory alloy (SMA) is that its transformation temperature zone can be adjusted by altering the alloy composition. Suitable SMAs may include: Ag—Cd, Au—Cd, Cu—Al—Ni, Cu—Sn, Cu—Zn, Cu—ZN—Si—Sn—Al, In—Ti, Ni—Al, Ni—Ti, Fe—Pt, Mn—Cu, Fe—Mn—Si, Pt alloys, Co—Ni—Al, Co—Ni—Ga. A nickel-titanium alloy is preferred.

The SMA may be magnetically inert (i.e. not sensitive to magnetic fields) but need not be so if sensitivity to magnetism is not critical. Some of the SMAs listed above include iron or cobalt. These alloys may have their memory triggered by external magnetic fields.

Where sensitivity to magnetic fields is important, the whole balance wheel may be made from a non-magnetically sensitive (i.e. magnetically inert) material.

The first aspect of the invention may also provide a mechanical oscillator system for a horological or other precision instrument which includes a combination of the balance wheel discussed above and a thermally stable balance spring. In this context, thermally stable may mean having a coefficient of thermal expansion that is less than $6\times10^{-6}$ $K^{-1}$. The balance spring may be made from a non-magnetically sensitive material, e.g. of any suitable material disclosed in WO 2004/008259.

Dynamically Adjusting Appendages

At its most general, the second aspect of the invention proposes two or more thermally compensating appendages on a balance wheel in which the intrinsic thermal expansion coefficient(s) of each appendage provides for the necessary change of mass distribution (and hence moment of inertia) within the balance wheel.

For a mechanical oscillator system in which the balance wheel and balance spring are made of a thermally stable material, the inventor has found it feasible to compensate for thermal effects by using appendages attached to a body of a balance wheel which move their centers of mass relative to the centre of mass of the body when they expand or contract with an increase or decrease in temperature.

This is in contrast to conventional bimetallic compensating balance wheels, where the thermal instability of the balance wheel and balance spring mean gross compensation is required. For example, in a conventional compensating balance wheel having a split bimetallic rim with a practical diameter, the required displacement of mass is around 35 μm per 20° C. and the volume of mass displaced is three times greater than the appendages considered herein. This is because the conventional bimetallic balance wheel is required to compensate not only for the variation of the elastic modulus of the balance spring to which it is coupled but also a part of its own mass which is displaced outward as the balance wheel expands with a rise in temperature. In fact, temperature compensating mass located at the end of the split balance rim, i.e. the displacing mass of the balance wheel, accounts for more than 50% of the adjustable mass of the balance wheel. This has a further disadvantage because the compensating mass is concentrated away from the centre of mass of the balance wheel e.g. at the point of maximum displacement which totals 40° of arc. This has presented a problem in the past in the regulating of precision timepieces as the inertia of the mass concentration is known to cause flexion of the free end of the balance wheel carrying the mass in the case of an external shock and a resultant change in rate is inevitable as a consequence.

According to the second aspect of the invention, there may be provided a balance wheel for a mechanical oscillator system in a horological or other precision instrument, the balance wheel comprising a body of thermally stable material and a plurality of compensating appendages arranged in equipoise on the body, wherein expansion or contraction of each appendage with an increase or decrease in temperature is arranged to move its centre of mass relative to the centre of mass of the body to alter a mass distribution of the balance wheel relative to its centre of mass.

Since the body itself is thermally stable, the thermal compensation arrangement does not have to perform significant compensation merely to negate the effects of movement of compensating mass caused by expansion or contraction of the body. The magnitude of compensatory movement and mass can therefore be reduced, which can improve accuracy, e.g. since smaller displacements are quicker to achieve so compensation is more immediate.

The balance wheel may be for use in conjunction with a thermally stable balance spring, wherein the mass distribution of the balance wheel relative to its centre of mass is alterable to compensate for a change in the elasticity of the balance spring caused by the increase or decrease in temperature.

Each appendage may comprise a mass element attached to the body via a compensation structure, the compensation structure being arranged to move the mass element relative to the centre of mass of the body with an increase or decrease in temperature. The movement is preferably caused by the expansion or contraction of the compensation structure. By selecting suitable values for the thermal expansion coefficient for the compensation structure and the mass of the mass element, changes in the elasticity of the spring may be compensated to maintain isochronism.

The compensation structure may include a curved strip of material, e.g. a split ring. The compensation structure may include any one or more of bimetallic, multi- or mono-material. Thus, the intrinsic thermal expansion coefficients of the material(s) in the appendage singly or in combination can provide the relative movement necessary for compensation. For example, the curved strip may include a bimetallic split ring which opens and closes with an increase or decrease in temperature. The mass element may be located within the split ring and attached to one or its ends so that it is drawn in or out of the split ring when the temperature changes.

The entire compensation structure may be a mono-material, e.g. comprising a curved part surrounded a inner mass element. As the curved part expands, the location of the centre of mass moves.

The order of magnitude of material movement at the scale of the oscillator for which the appendages are destined may be less than 1 $\mu m\cdot K^{-1}$ for mono-materials and less than 3 $\mu m\cdot K^{-1}$ for bi- or multi-materials. The inventor has noticed that for an incremental radius of gyratory mass change of $2\times10^{-4}$ mm from a given point for a given E modulus within a low thermal expansion balance wheel the rate of change is 1 second in twenty-four hours.

By the use of different material linear thermal expansion rates the thermal changes to E and the effect on time keeping can be compensated.

The inventor has also observed that a limit to thermal expansion of the balance wheel can usefully be adopted as the small incremental changes afforded by the appendages proposed are designed to compensate for slight E variations and this is best accomplished in conjunction with a balance wheel having a linear thermal expansion less than $9\times10^{-6}$ $K^{-1}$, as discussed above.

The material of the balance wheel, appendage and/or balance spring may be magnetically inert, i.e. non-magnetically sensitive. Materials disclosed in WO 2004/008259 and WO 2005/040943 may be used. The appendages may be made from plastics material, e.g. PTFE or other easily formable material. The mass element may include a titanium weight or a weight made of a material with a greater or lesser density.

The mass element may be adjustable to permit static variation of the location of the centre of mass of the appendage. For example, the mass element may comprise an insert (e.g. including the weight mentioned above) that is rotatable relative to the compensation structure, the insert having a centre of mass offset from its axis of rotation. The offset may be achieved by providing the insert with an eccentric mass distribution. This adjustability enables the magnitude of mass displacement, i.e. the distance travelled by the appendages centre of mass during expansion or contraction, to be controlled by permitting the position of the centre of mass of the appendage to be moved relative to the compensating structure.

Each appendage may be located in a respective recess formed in the body. For example, they may be situated at an equal radial distance from the centre of mass of the balance wheel and may be equally spaced in recesses formed within the material thickness of the body. This can reduces drag experienced by the oscillating system.

Each appendage may be disc-shaped and may be rotatable in its recess. This provides a second degree of adjustability in that the magnitude of movement along the radius of the balance wheel can be controlled. Indeed, the movement can be changed from inward to outward by suitably rotating the appendage. Thus, with minor adjustments, the same balance wheel and appendages of the second aspect can be used with springs having both 'normal' and 'abnormal' thermoelastic characteristics. In other words, the appendages may be oriented within the balance wheel in such a way as to contribute most accurately to the rate of change of compensation.

The recesses or apertures which receive the appendages may by their shape guide the relative movement of their respective appendage as it changes shape with a change in temperature. This arrangement may be useful if the mass displacement is required to obey a non-linear relationship or compensate for a non-linear evolution of E. For example, as explained in WO 2004/008259 equation 1 can be simplified to $$T \propto \frac{r}{\sqrt{E}}. \qquad 4$$

At least two appendages are provided. More may be used, e.g. to satisfy equations 1 and 3 in terms of inertia and the balance spring elasticity Alternatively or additionally, the appendages themselves may include formations, e.g. guide edges or the like, which constrain the movement of the appendage centre of mass during expansion or contraction, e.g. to provide the necessary rate of change of mass displacement within their own periphery, such mass displacement being prescribed within the appendage.

Each appendage may be fixed within its recess. For example, each appendage may have an enlarged end portion which may be held captive in a similarly shaped slot or adhered or fixed in a non-captive slot or recess in the balance wheel. In this arrangement, the unfixed end of the appendage effects the mass change by moving relative to the fixed point with an increase or decrease in temperature.

Features of the first aspect may be combined with the second aspect.

BRIEF DESCRIPTION OF THE DRAWINGS

Examples embodying the aspects of the invention described above are described below with reference to the accompanying drawings, in which.

DETAILED DESCRIPTION; FURTHER OPTIONS AND PREFERENCES

Shape Memory Material

Figure 1:
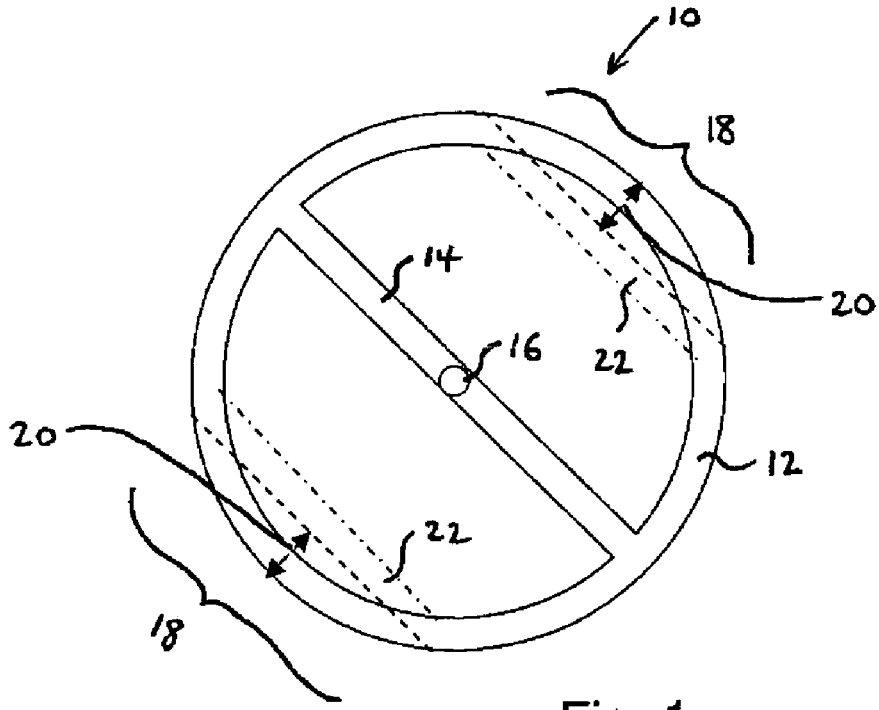
FIG. 1 is a plan view of a balance wheel that is a first embodiment of the first aspect of the invention.

FIG. 1 is a plan view of a balance wheel 10 which incorporates a thermal compensation arrangement according to the first aspect of the invention. The balance wheel 10 has a generally circular rim 12 with a cross member 14 extending across a diameter thereof. At the centre of the cross member 14 there is an upstanding balance staff 16 to which a balance spring (not shown) is attached. In this embodiment, the rim includes two compensation portions 18 symmetrically arranged around the balance staff 16. The two compensation portions 18 are substantially identical to one another, so the symmetrical arrangement ensures that the balance wheel 10 remains in equipoise.

Each of the compensation portions 18 comprises shape memory material, which in this embodiment is a shape memory alloy of nickel-titanium. The compensation portions 18 are pre-programmed to exhibit a two-way shape memory effect whereby they move in the direction indicated by arrows 20, i.e. radially inwards or outwards with respect to the balance staff 16, with an increase or decrease in temperature.

The pre-programming procedure involves a repeated cycle of bending the cooled alloy to a desired shape or configuration (e.g. indicated by dotted lines 22 in FIG. 1) and subsequently heating to above an austenitic transformation temperature where upon the original shape is regained. As a result of the pre-programming, the compensation portions 18 will move between the configurations according to the temperature they experience. When the compensation portions 18 move towards the balance staff 16 (i.e. towards the centre of mass of the balance wheel), the radius of gyration of the balance wheel 10 is effectively reduced because the mass distribution around the centre of mass is altered. Accordingly, the moment of inertia of the balance wheel can be reduced. By suitably selecting the distance of mass displacement and the size of mass displaced, this definition according to temperature can compensate for changes in the elasticity of the balance spring with temperature. The theory behind such calculations is known, e.g. disclosed in the inventor's earlier patent publications WO 2004/008259 and WO 2005/040943.

Figure 2:
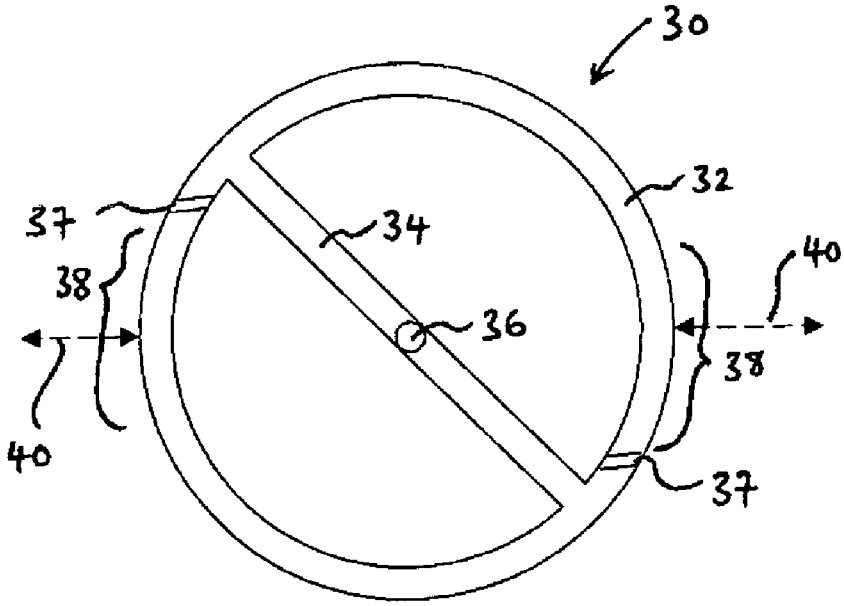
FIG. 2 is a plan view of a balance wheel that is a second embodiment of the first aspect of the invention.

FIG. 2 shows a balance wheel 30 that is another embodiment of the first aspect of the invention. The balance wheel 30 of this embodiment has a similar overall shape to the balance wheel 10 shown in FIG. 1, i.e. a generally circular rim 32 with a cross member 34 along a diameter thereof and a balance staff 36 at the centre. In this embodiment, the rim 32 has two splits 37 therein. The compensation portions 38 are provided on portions of the rim adjacent to the splits 37 in an anticlockwise direction. The compensation portions 38 may be pre-programmed as described above to move radially inwards or outwards with respect to the balance staff 36 (centre of mass of the balance wheel) in a complementary manner (indicated by arrows 40 in FIG. 2) such that the balance wheel 30 maintains equipoise.

The embodiments shown in FIGS. 1 and 2 may be made entirely from shape memory material, or only the compensation portions may include shape memory material. For ease of manufacture, it may be desirable for the embodiment to be mono-material. The embodiments shown in FIGS. 1 and 2 may further include radial screws (not shown) mounted on the rim. The radial screws may serve as both poising adjustment elements and to aid in the shape pre-programming process, e.g. to ensure accurate repeatable deformation of the compensation portions.

Figure 3:
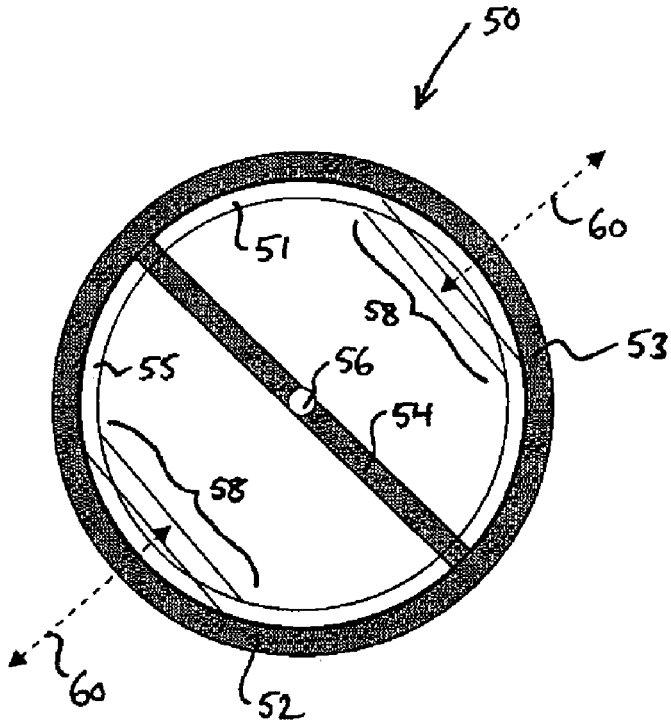
FIG. 3 a plan view of a balance wheel that is a third embodiment of the first aspect of the invention.

FIG. 3 shows a balance wheel 50 that is another embodiment of the first aspect of the invention. In this embodiment, a mass displacement element 51 is mounted within a standard industry balance wheel 53 (e.g. of Cu—Be or Au—Cu) to produce a compensation effect. Indeed, the mass displacement element 51 may compensate for both elastic modulus changes in a balance spring (not shown) attached to the balance wheel 53 and for the expansion effects of the balance wheel 53 itself.

The standard balance wheel 53 comprises a circular rim 52 with a cross member 54 along a diameter thereof and a balance staff 56 at its centre. The mass displacement element 51 may resemble the balance wheel 10 shown in FIG. 1. It comprises a generally circular rim 55 adapted to fit within the inner circumference of the balance wheel rim 52. The mass displacement element rim 55 includes compensation portions 58 made of shape memory material which are pre-programmed to move radially inwards or outwards with respect to the centre of the balance wheel 53 with an increase or decrease in temperature, as described above. The radial movement is indicated by arrows 60 in FIG. 3. FIG. 3 also shows the two extreme positions of the compensation portions 58, i.e. an inner configuration in which the compensation portions are drawn towards the centre of the balance wheel 53 and an outer configuration where they lie along the inner circumference of the balance wheel rim 52.

Figure 4:
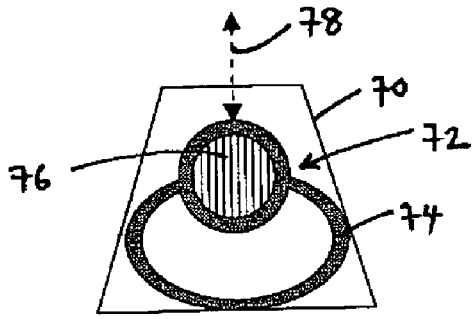
FIG. 4 is a schematic view of an insert for a balance wheel that is another embodiment of the first aspect of the invention.

In the embodiments described above, portions of the balance wheel rim are adapted to deform with an increase or decrease in temperature. In other embodiments, a static (i.e. thermally stable) balance wheel may have shape memory material inserts mounted in recesses formed therein. FIG. 4 shows a schematic representation of such an insert. In this arrangement, a trapezoidal hole 70 may be formed in the balance wheel to receive and hold captive a shape memory material insert 72. The insert comprises a compensation portion 74 having an appendage mass 76 mounted thereon. The compensation portion 74 is pre-programmed as discussed above to move the appendage mass 76 within the hole 70 (as indicated by arrow 78) with an increase or decrease in temperature. In other embodiments, the inserts may not include an appendage mass but remain free to change shape within the slot with an increase or decrease in temperature to cause a change in mass distribution on the balance wheel and hence a change in the moment of inertia of that wheel.

The use of shape memory material inserts permits the present invention to be used with thermally stable balance wheels, e.g. made of ceramic or other suitable material (e.g. having a thermal expansion coefficient of $9\times10^{-6}\,K^{-1}$ or less) as disclosed in WO 2004/008259 and/or WO 2005/040943.

An alternative unillustrated embodiment of the first aspect of the invention provides adjustment screws, e.g. radial adjustment screws for standard balance wheels, which adjustment screws are formed from shape memory materials, e.g. shape memory alloys. Thus, the screw may include a portion which bends with a temperature change to a pre-programmed position to increase or reduce the moment of inertia of the balance wheel whilst retaining a straight portion which allows it to function also as an adjusted screw. It is envisaged that this embodiment may be of particular use with standard split balance wheels.

Dynamically Adjusting Appendages

The second aspect of the invention relates to the intrinsic compensation performed by an insert or appendage to a balance wheel or part of a balance wheel when the relative expansion or contraction of the insert or appendage with respect to the balance wheel changes the radius of gyration of the balance wheel to alter its moment of inertia. Accordingly, the second aspect is most beneficial when the balance wheel itself has a low thermal expansion coefficient (e.g. less than $9\times10^{-6}\,K^{-1}$, preferably less than $1\times10^{-6}\,K^{-1}$). Having a thermally stable balance wheel reduces the amount of compensation required of the appendages.

In embodiments of this aspect of the invention, a balance wheel (not shown) includes a plurality (i.e. at least two) recesses for receiving the dynamically adjusting appendages that characterize the second aspect of the invention. The appendages are arranged on the balance wheel to ensure that it remains in equipoise.

Figure 5:
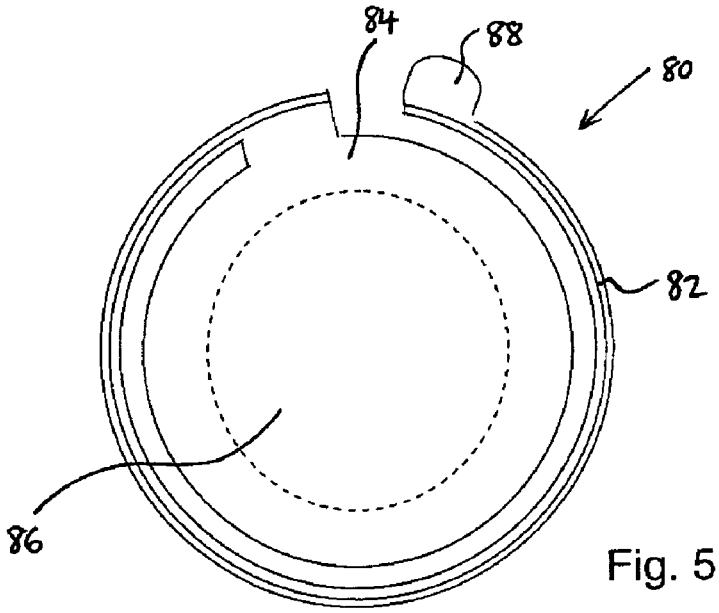
FIG. 5 is a plan view of an appendage for a balance wheel that is a first embodiment of the second aspect of the invention.
Figure 6:
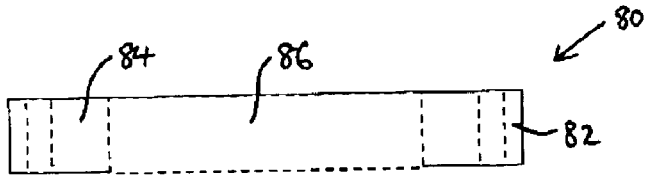
FIG. 6 is a side view of the appendage shown in FIG. 5.

FIGS. 5 and 6 show an appendage 80 for a balance wheel that is an embodiment of the second aspect of the invention. The appendage 80 is generally circular and comprises an outer curved bimetallic strip 82, e.g. formed of gold and silver or any other suitable bi- or multi-metal material, that is attached to an inner mass element 84, which may have an additional weight 86 mounted thereon. A free end of the bimetallic strip 82 has an attachment tab 88 for securing the appendage 80 in a recess in the balance wheel. Accordingly, when the appendage experiences an increase or decrease in temperature, the diameter of the circle defined by the bimetallic strip changes according to its expansion or contraction which moves the mass element 84 within the recess in the balance wheel. Accordingly, the centre of mass of the appendage can move radially inwards or outwards with respect to the centre of mass of the balance wheel, thereby altering its moment of inertia and enabling compensation for thermal effects experienced by the balance spring.

The materials for the appendage 80 may be selected according to the required mass displacement. This may vary according to the elastic modulus variation of the spring. Generally speaking, inward and outward curving movement of the bimetallic strip will cause a near linear displacement of the centre of mass of the appendage.

Figure 7:
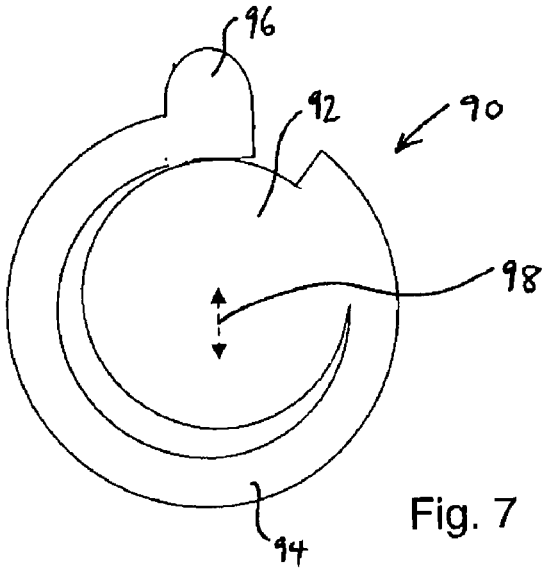
FIG. 7 is a plan view of an appendage for a balance wheel that is a second embodiment of the second aspect of the invention.

FIG. 7 shows an alternative arrangement for a dynamically adjusting appendage according to the second aspect of the invention. The appendage 90 shown in FIG. 7 is formed of a mono-material, e.g. plastic, preferably PTFE. It may carry an additional weight (not shown) e.g. of titanium or other material. The appendage comprises an inner head (mass element) portion 92 that is substantially circular and is attached to one end of a circumferentially extending curved tail portion 92 which terminates in an outwardly extending tab 96 for securing the appendage 90 in a recess of a balance wheel (not shown). In other embodiments, the curved tail portion may be elongate, e.g. describe an oval, to increase the space available for movement of the head portion. With an increase in temperature, the material expands, which effectively causes the tail portion 94 to increase in length. When constrained in a recess, the increase in length of the tail portion 94 causes relative movement between head portion 92 and tab 96. This relative movement causes the centre of mass of the appendage to move within the recess. This movement can alter the moment of inertia of the balance wheel and be controlled to compensate for thermal changes of the properties of the spring. The arrow 98 in FIG. 7 shows how the centre of mass of the appendage 90 moves with an increase in temperature. The extent of relative movement can be controlled by the length of the tail portion 94 (i.e. distance along the tail between the tab 96 and the point of attachment to the head portion 92) since for a mono-material the magnitude of expansion is related by the linear thermal expansion coefficient $\alpha$ to the actual length of material.

In an alternative unillustrated embodiment, the appendages may not be fixed within the recesses formed in the balance wheel. For example, the tabs 88, 98 shown in FIGS. 5 and 7 may be attached to annular rims which are received in circular recesses formed in the balance wheel, thereby permitting rotation of the appendage within the recess. An advantage of this rotation is that the alignment of appendage movement with the radius of the balance wheel can be adjusted to vary the effect that a single appendage can have on the moment of inertia of a balance wheel for a given change in temperature. For example, the same set of appendages can be used to compensate for both "normal" and "abnormal" thermal elastic spring behavior simply by being rotated through 180 degrees within their respective recesses. Moreover, if a weight is adjustably mounted on the appendage (e.g. eccentrically rotatable thereon) the extent of displacement of the centre of mass of the appendage with expansion or contraction can also be controlled. This may permit fine tuning of the thermal behavior of the appendages, since each appendage is effectively doubly adjustable. In this embodiment, both the extent of displacement of the centre of mass with expansion/contraction and the relative angle of displacement with respect to the balance wheel radius are adjustable. This can make a single (e.g. mass producible) appendage capable of compensating for a wide variety of spring characteristics.

The appendages disclosed herein whether of regular symmetrical or non-symmetric form may be produced by micromachining or processing methods which may include the removal, cutting, separating or parting of material by any suitable process, whether mechanical, electrical, electron, chemical, water, gas or photon means or a combination of these, or micro-molding, injection or micro-forming means.

The invention claimed is:

1. A balance wheel for use in conjunction with a balance spring in a mechanical oscillator system in a horological or other precision instrument, the balance wheel comprising:

a body of non-magnetically sensitive material having a linear coefficient of thermal expansion of $9\times10^{-6}\,K^{-1}$ or less; and a plurality of non-magnetically sensitive compensating appendages arranged in equipoise on the body, each appendage comprising a mass element attached to the body via a compensation structure, the compensation structure being arranged to move the mass element relative to the centre of mass of the body with an increase or decrease in temperature;

wherein the mass element is adjustably mounted on the compensation structure to permit the position of the centre of mass of the mass element relative to the compensation structure to be altered;

the compensation structure is adjustably mounted on the body to permit a direction of movement of the mass element relative to the centre of mass of the body with an increase or decrease in temperature to be altered; and expansion or contraction of each appendage with an increase or decrease in temperature is arranged to move its centre of mass relative to the centre of mass of the body to alter a mass distribution of the balance wheel relative to its centre of mass to compensate for a change in the elasticity of the balance spring caused by the increase or decrease in temperature.

2. A balance wheel according to claim 1, wherein the compensation structure includes a curved strip of material.

3. A balance wheel according to claim 2, wherein the curved strip includes a bimetallic strip.

4. A balance wheel according to claim 1, wherein the compensation structure is a mono-material comprising a shape memory alloy.

5. A balance wheel according to claim 1, wherein the mass element comprises an insert that is rotatable relative to the compensation structure, the insert having a centre of mass offset from its axis of rotation.

6. A balance wheel according to claim 1, wherein each appendage is located in a respective recess formed in the body.

7. A balance wheel according to claim 6, wherein each appendage is rotatable in its recess.

8. A balance wheel for a mechanical oscillator system in a horological or other precision instrument, all or part of the balance wheel comprising shape memory material that is arranged to change shape with an increase or decrease in temperature to alter a mass distribution of the balance wheel relative to its centre of mass.

9. A thermally compensating balance wheel for use in conjunction with a thermally stable balance spring in a mechanical oscillator system in a horological or other precision instrument, the balance wheel including a compensation portion made of shape memory material, wherein the compensation portion is arranged to change shape with an increase or decrease in temperature to alter a mass distribution of the balance wheel relative to its centre of mass to compensate for a change in the elasticity of the balance spring caused by the increase or decrease in temperature.

10. A balance wheel according to claim 9, wherein the compensation portion includes two or more discrete shape changing elements located on the balance wheel such that it has equipoise.

11. A balance wheel according to claim 10 having a rim and a cross member, wherein the shape changing elements are part of the rim.

12. A balance wheel according to claim 10 having a body with recesses in which the shape changing elements are mounted.

13. A balance wheel according to claim 10, wherein each shape changing element includes a mass element that is movable radially inwards or outwards within the plane of the balance wheel relative to the centre of mass of the balance wheel when the shape memory material changes shape with an increase or decrease in temperature.

14. A balance wheel according to claim 10 that is made from a non-magnetically sensitive material, wherein the shape memory material is a shape memory alloy.

15. A mechanical oscillator system for a horological or other precision instrument, the system including a thermally compensating balance wheel connected to a balance spring made from a non-magnetically sensitive material having a coefficient of thermal expansion that is less than $6\times10^{-6}\,K^{-1}$, the balance wheel including a compensation portion made of shape memory material, wherein the compensation portion is arranged to change shape with an increase or decrease in temperature to alter a mass distribution of the balance wheel relative to its centre of mass to compensate for a change in the elasticity of the balance spring caused by the increase or decrease in temperature.

* * * * *